US012685344B2

(12) United States Patent
Hou et al.

(10) Patent No.: US 12,685,344 B2
(45) Date of Patent: Jul. 21, 2026

(54) AUXILIARY APPARATUS FOR E-LIQUID TRANSPORTATION AND INJECTION

(71) Applicant: SHENZHEN HANQINGDA TECHNOLOGY CO., LTD., Shenzhen (CN)

(72) Inventors: Shoushan Hou, Shenzhen (CN); Tianli Zhang, Shenzhen (CN); Yaguang Wang, Shenzhen (CN)

(73) Assignee: SHENZHEN HANQINGDA TECHNOLOGY CO., LTD., Shenzhen (CN)

( * ) Notice: Subject to any disclaimer, the term of this patent is extended or adjusted under 35 U.S.C. 154(b) by 662 days.

(21) Appl. No.: 18/265,185

(22) PCT Filed: Dec. 21, 2022

(86) PCT No.: PCT/CN2022/140533
§ 371 (c)(1),
(2) Date: Jun. 2, 2023

(87) PCT Pub. No.: WO2023/125174
PCT Pub. Date: Jul. 6, 2023

(65) Prior Publication Data

US 2024/0423291 A1 Dec. 26, 2024

(30) Foreign Application Priority Data

Dec. 31, 2021 (CN) ..... 202123429190.3

(51) Int. Cl.
*B65B 43/54* (2006.01)
*A24F 40/10* (2020.01)
(Continued)

(52) U.S. Cl.
CPC ..... *A24F 40/70* (2020.01); *A24F 40/10* (2020.01); *A24F 40/40* (2020.01); *B65B 43/54* (2013.01)

(58) Field of Classification Search
CPC ..... A24F 40/10; A24F 40/40; A24F 40/70; B65B 43/54
See application file for complete search history.

(56) References Cited

U.S. PATENT DOCUMENTS 10,011,381 B2 * 7/2018 Deutschle ..... B65D 51/241
10,207,832 B2 * 2/2019 Narvekar ..... B01L 3/5082
(Continued)

FOREIGN PATENT DOCUMENTS

CN 203938459 11/2014
CN 209073562 7/2019
(Continued)

OTHER PUBLICATIONS

International Search Report issued in International Application No. PCT/CN2022/140533, mailed Mar. 3, 2023 (6 pages).
(Continued)

*Primary Examiner* — Nicolas A Arnett
(74) *Attorney, Agent, or Firm* — Quarles & Brady LLP

(57) ABSTRACT

An auxiliary apparatus for E-liquid transportation and injection is disclosed, which includes an installation base, a lower swing disc jig and a mouthpiece tray. Limiting notches are provided respectively at inner sides of two ends of the installation base, an upper end of the limiting notch is connected with an installation side frame, and a bump is fixedly connected with front and rear ends of an upper side of the installation side frame. The lower swing disc jig is connected to a lower end of an inner side of the installation side frame, and an inwardly-concaved groove is provided in a middle of a lower end of the lower swing disc jig.

7 Claims, 3 Drawing Sheets

(51) Int. Cl.
*A24F 40/40* (2020.01)
*A24F 40/70* (2020.01)

(56) References Cited

U.S. PATENT DOCUMENTS

| | | | | |
|---|---|---|---|---|
| 10,440,989 | B2 * | 10/2019 | Gardella | B65B 39/005 |
| 10,850,874 | B2 * | 12/2020 | Boldrini | B65B 3/28 |
| 11,344,064 | B2 * | 5/2022 | Davis | A24F 40/48 |
| 11,679,905 | B1 * | 6/2023 | Ellis | B65B 43/59 141/1 |
| 11,744,294 | B2 * | 9/2023 | Kwon | A24F 15/01 131/328 |
| 2003/0044324 | A1 * | 3/2003 | Micklash, II | B01J 19/0046 435/305.3 |
| 2015/0089830 | A1 * | 4/2015 | Wissner | B65B 7/2892 34/92 |
| 2020/0015516 | A1 * | 1/2020 | Simpson | A24C 5/01 |
| 2020/0060336 | A1 | 2/2020 | Liu | |
| 2021/0171231 | A1 * | 6/2021 | Bumatai | B65B 3/12 |
| 2021/0221547 | A1 * | 7/2021 | Zaniboni | A24F 40/42 |
| 2022/0033124 | A1 * | 2/2022 | Partansky | B67C 3/26 |
| 2022/0227566 | A1 * | 7/2022 | Nau | B65B 7/2821 |

FOREIGN PATENT DOCUMENTS

| | | | | |
|---|---|---|---|---|
| CN | 211323046 | | 8/2020 | |
| CN | 111887477 | A | 11/2020 | |
| CN | 216674695 | | 6/2022 | |
| CN | 118555923 | A * | 8/2024 | B65B 7/2842 |

OTHER PUBLICATIONS

Written Opinion of the International Search Authority issued in International Application No. PCT/CN2022/140533, mailed Mar. 3, 2023 (5 pages).

* cited by examiner

AUXILIARY APPARATUS FOR E-LIQUID TRANSPORTATION AND INJECTION

CROSS-REFERENCE TO RELATED APPLICATIONS

This application is a national stage filing under 35 U.S.C. § 371 of international application number PCT/CN2022/140533, filed Dec. 21, 2022, which claims priority to Chinese patent application No. 202123429190.3 filed Dec. 31, 2021. The contents of these applications are incorporated herein by reference in their entirety.

TECHNICAL FIELD

The embodiments of the disclosure relate to the field of electronic cigarette E-liquid injection, and particularly relates to an auxiliary apparatus for E-liquid transportation and injection.

BACKGROUND

Electronic cigarette is an electronic product that imitates cigarettes and has the same appearance, smoke, taste and feeling as cigarettes. The electronic cigarette is a product which is powered by a rechargeable lithium polymer battery to drive an atomizer, and turns nicotine into steam by heating an E-liquid in an E-liquid tank, so that users can smoke the electronic cigarette.

The auxiliary apparatus for E-liquid transportation and injection on the market has a problem that the E-liquid injection is carried out by a single needle or at most ten needles, and the efficiency is low. Therefore, embodiments of the disclosure provide an auxiliary apparatus for E-liquid transportation and injection.

SUMMARY

The embodiments of the disclosure provide an auxiliary apparatus for E-liquid transportation and injection, so as to solve the problems in the background above.

To achieve the foregoing object, the embodiments of the disclosure provide the following technical solutions. An auxiliary apparatus for E-liquid transportation and injection comprises an installation base, a lower swing disc jig and a mouthpiece tray, wherein limiting notches are provided respectively at inner sides of two ends of the installation base, and an upper end of each of the limiting notches is connected with an installation side frame, a bump is fixedly connected with front and rear ends of an upper side of the installation side frame, the lower swing disc jig is connected to a lower end of an inner side of the installation side frame and an inwardly-concaved groove is provided in a middle of a lower end of the lower swing disc jig, an upper end of the inner side of the installation side frame is connected with an upper swing disc jig and a middle of the upper swing disc jig is provided with an installation hole, the upper side of the installation side frame is connected with a mouthpiece correction jig and an upper end of the mouthpiece correction jig is connected with a cigarette rod tray, an inside of the cigarette rod tray is connected with a cigarette rod body, an outer end of an upper side of the cigarette rod tray is fixedly connected with a convex buckle, the mouthpiece tray is connected with an upper end surface of the cigarette rod tray, the mouthpiece tray is internally connected with a mouthpiece body, and the mouthpiece body is internally provided with a reinforcing assembly for leakage prevention.

Further, the installation side frame is buckled with the installation base, two installation side frames are symmetrically arranged about a vertical central axis of the installation base, and the installation side frame is hollow.

Further, the upper swing disc jig and the lower swing disc jig are distributed in parallel, and the lower swing disc jig is in a concave shape.

Further, the installation holes are evenly distributed inside the upper swing disc jig and the installation holes are obliquely distributed.

Further, the mouthpiece tray is buckled with the mouthpiece correction jig, and a structure of the mouthpiece tray is matched with a structure of the mouthpiece correction jig.

Further, the reinforcing assembly comprises a silica gel sealing ring, a first leakage-proof groove, a second leakage-proof groove, a leakage-proof cotton and a leakage-proof protrusion, a middle of an upper end of the silica gel sealing ring is provided with the first leakage-proof groove, an inner side of the upper end of the silica gel sealing ring is provided with the second leakage-proof groove, a lower end of an inner side of the silica gel sealing ring is connected with the leakage-proof cotton, and an upper end of a lower side of the silica gel sealing ring is provided with the leakage-proof protrusion.

Further, two first leakage-proof grooves are symmetrically arranged about a vertical central axis of the silica gel sealing ring, and an outer wall connecting surface of the silica gel sealing ring and an inner wall connecting surface of the mouthpiece body are mutually attached to each other.

The auxiliary apparatus for E-liquid transportation and injection provided by the embodiments of the disclosure has the beneficial effects as follows.

The auxiliary apparatus for E-liquid transportation and injection is stable during E-liquid injection by a clamping mode, without deviation and dislocation. Meanwhile, the whole auxiliary apparatus for E-liquid transportation and injection is provided with one hundred installation notches through which the E-liquid can be injected at the same time, so that the overall E-liquid injection efficiency is improved, and the E-liquid injection is efficient, fast and accurate.

The auxiliary apparatus for E-liquid transportation and injection is provided with the installation side frames, the installation side frames are clamped in the limiting notches formed in the inner side of the upper end of the installation base and matched with the limiting notches in structural size for installation, the installation side frames are easy to disassemble from and assemble with and the installation base through a clamping connection with the limiting notches, which facilitates overall maintenance and replacement. A square through hole is correspondingly formed in the whole installation side frame, so that on one hand, the user can conveniently grasp and take the apparatus for use, and on the other hand, materials of the whole apparatus are saved, and an overall weight of the apparatus is reduced.

The auxiliary apparatus for E-liquid transportation and injection is provided with the upper swing disc jig, and the upper end of the upper swing disc jig is distributed with one hundred installation holes with equal distance, and the installation holes are distributed in a structure inclined to the upper swing disc jig, so that more installation holes can be planned on the surface of the upper swing disc jig with a square structure, a utilization rate of an internal space of the whole inside of the upper swing disc jig is improved. Meanwhile, one hundred installation holes can simultaneously inject E-liquid for one hundred electronic cigarettes, thereby improving the overall efficiency.

The auxiliary apparatus for E-liquid transportation and injection is provided with the silica gel sealing ring, attaching one piece of silica gel sealing ring at a position where the cigarette rod body and the mouthpiece body are buckled can prevent the airflow from spreading, and make the airflow of the product more concentrated. Two first leakage-proof grooves are correspondingly formed at the upper end of the silica gel sealing ring, so that a heating element lead can be clamped, and liquid can be prevented from flowing down the lead, so that a certain leakage-proof effect is achieved. The second leakage-proof groove is also arranged at the middle of the inner side of the silica gel sealing ring, so that part of liquid can be prevented from being left. Moreover, the residual liquid is absorbed by the leakage-proof cotton. Meanwhile, the bottom side of the silica gel sealing is provided with the anti-leakage protrusion, so that even if liquid flows down, the liquid is blocked by the leakage-proof protrusion and does not flow to a control panel below; thereby strictly protecting the control panel.

Figure 1:
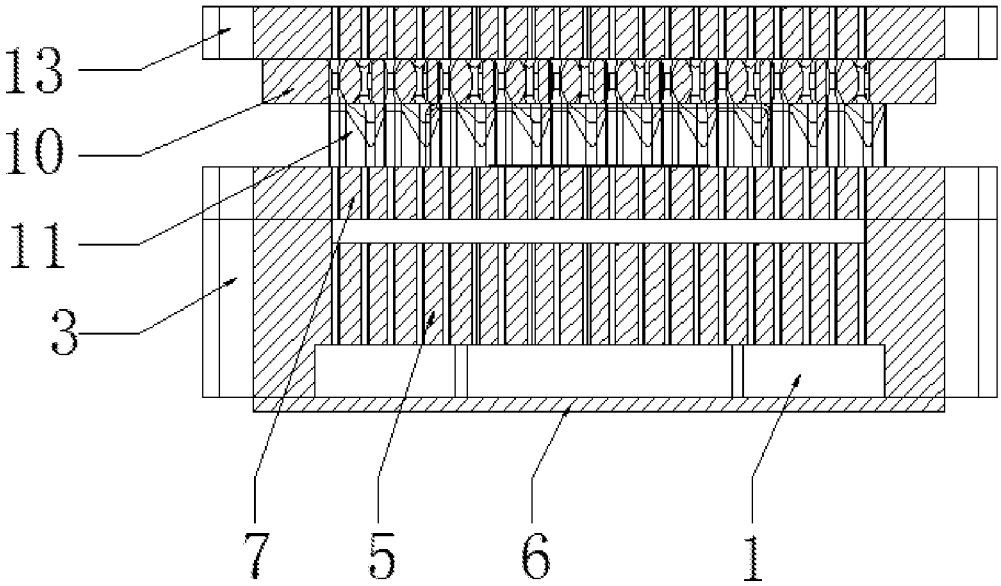
FIG. 1 is a front cross-sectional view according to the embodiments of the disclosure.

Reference numerals: 1—installation base; 2—limiting notch; 3—installation side frame; 4—bump; 5—lower swing disc jig; 6—inwardly-concaved groove; 7—upper swing disc jig; 8—installation hole; 9—mouthpiece correction jig; 10—cigarette rod tray; 11—cigarette rod body; 12—convex buckle; 13—mouthpiece tray; 14—mouthpiece body; 15—reinforcing assembly; 1501—silica gel sealing ring; 1502—first leakage-proof groove; 1503—second leakage-proof groove; 1504—leakage-proof cotton; and 1505—leakage-proof protrusion.

DETAILED DESCRIPTION

Figure 2:
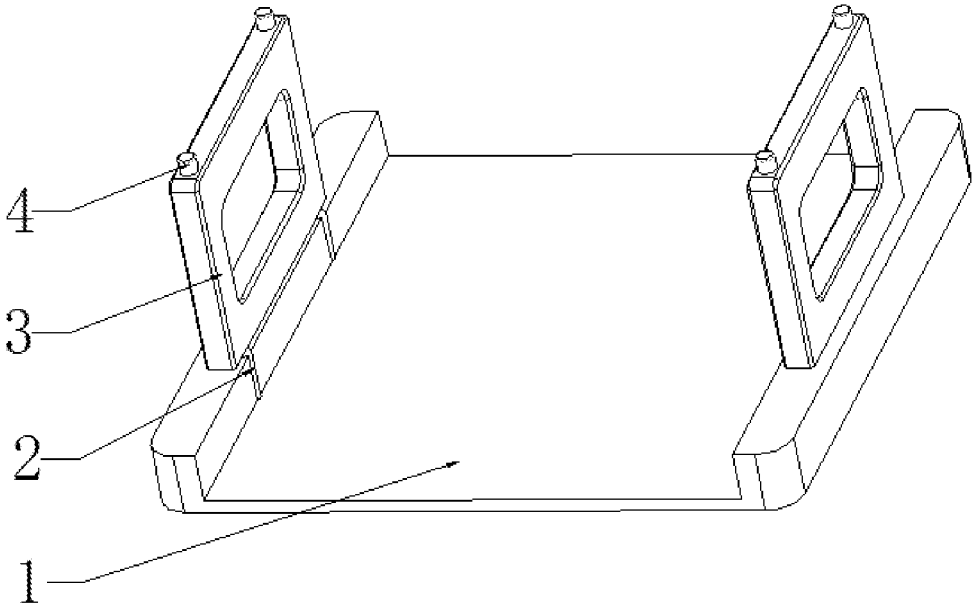
FIG. 2 is a schematic perspective view showing an installation base and an installation side frame according to the embodiments of the disclosure.

As shown in FIG. 1 and FIG. 2, an auxiliary apparatus for E-liquid transportation and injection comprises an installation base 1, a lower swing disc jig 5 and a mouthpiece tray 13. Limiting notches 2 are provided respectively at inner sides of two ends of the installation base 1, and an upper end of each of the limiting notches 2 is connected with an installation side frame 3. The installation side frame 3 is buckled with the installation base 1, and two installation side frames 3 are symmetrically arranged about a vertical central axis of the installation base 1. Moreover, the installation side frame 3 is hollow. The installation side frame 3 is clamped in the limiting notch 2 with the same structural size opened at an inner side of an upper end of the installation base 1 for installation. The installation side frame 3 and the limiting notch are easy to disassemble and assemble through the clamping connection of the limiting notch 2, which is convenient for overall maintenance and replacement. A square through hole is opened in the corresponding whole installation side frame 3, which is convenient for users to grasp and use on one hand, and a material of the whole apparatus is saved and an overall weight of the apparatus is reduced on the other hand. A bump 4 is fixedly connected with front and rear ends of an upper side of the installation side frame 3.

Figure 6:
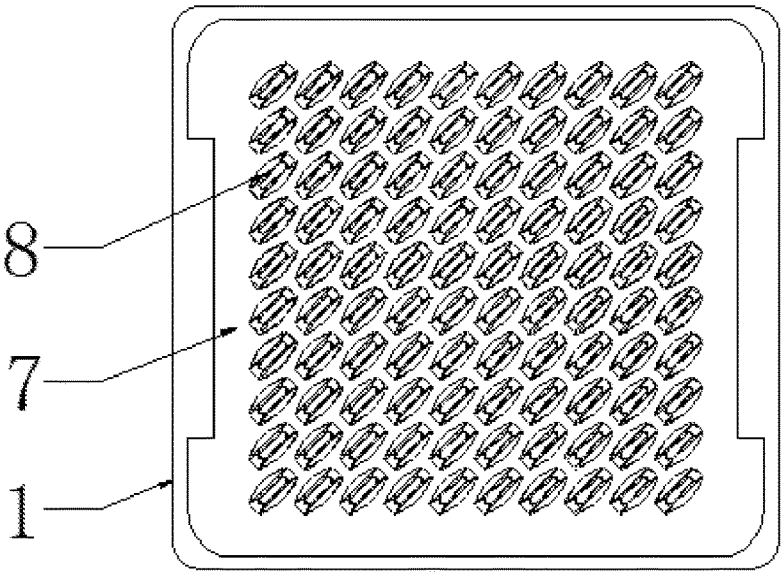
FIG. 6 is a top view of an upper swing disc jig according to the embodiments of the disclosure.

As shown in FIG. 1 and FIG. 6, the lower swing disc jig 5 is connected to a lower end of an inner side of the installation side frame 3 and an inwardly-concaved groove 6 is provided in a middle of a lower end of the lower swing disc jig 5. An upper end of the inner side of the installation side frame 3 is connected with an upper swing disc jig 7 and a middle of the upper swing disc jig 7 is provided with an installation hole 8. The upper swing disc jig 7 and the lower swing disc jig 5 are distributed in parallel. and the lower swing disc jig 5 is "concave". The upper swing disc jig 7 and the lower swing disc jig 5 installed inside the installation side frames 3 are parallel. When a cigarette body is connected through the upper swing disc jig 7 and the lower swing disc jig 5. the use of the whole material is reduced under the condition of not affecting a normal clamping stability through the upper swing disc jig 7 and the lower swing disc jig 5 which are not contacted. Moreover, it is more convenient to place and take out the whole electronic cigarette. The lower end of the corresponding lower swing disc jig 5 is provided with an inwardly-concaved groove 6, which can effectively prevent a bottom plastic sleeve from falling off. The installation holes 8 are evenly distributed inside the upper swing disc jig 7, and the installation holes 8 are obliquely distributed. A plurality of installation holes 8 are distributed at the upper end of the upper swing disc jig 7 at equal distances, and the whole installation holes 8 are distributed in a structure inclined to the upper swing disc jig 7, so that more installation holes 8 can be planned on the surface of the upper swing disc jig 7 with a square structure, and a utilization rate of an internal space of the whole upper swing disc jig 7 is improved.

Figure 3:
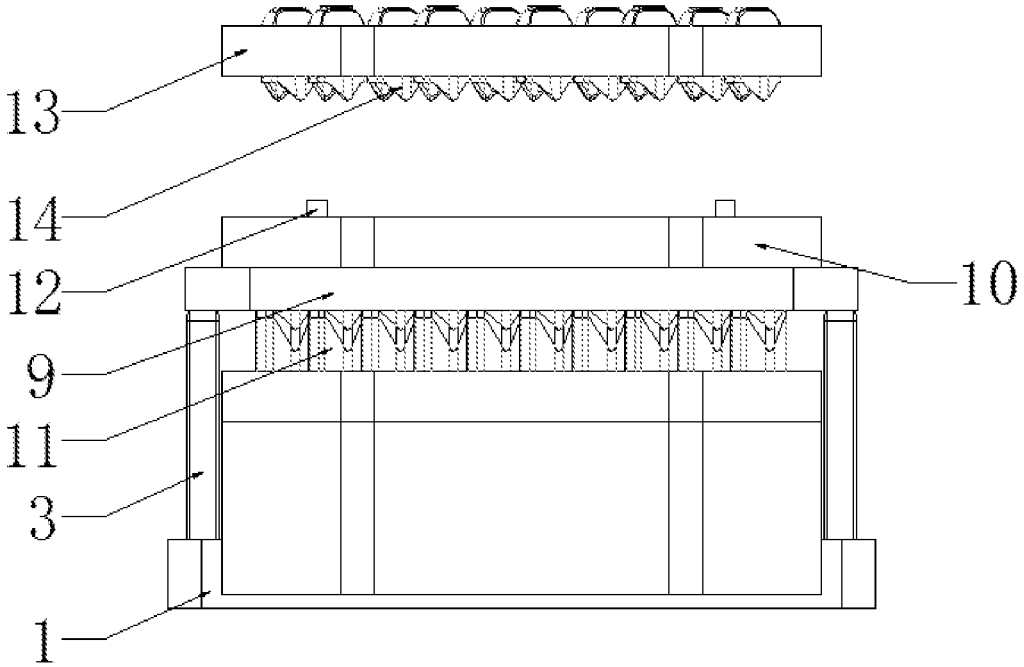
FIG. 3 is a schematic view showing a cigarette rod tray and a mouthpiece tray which are separated according to the embodiments of the disclosure.
Figure 4:
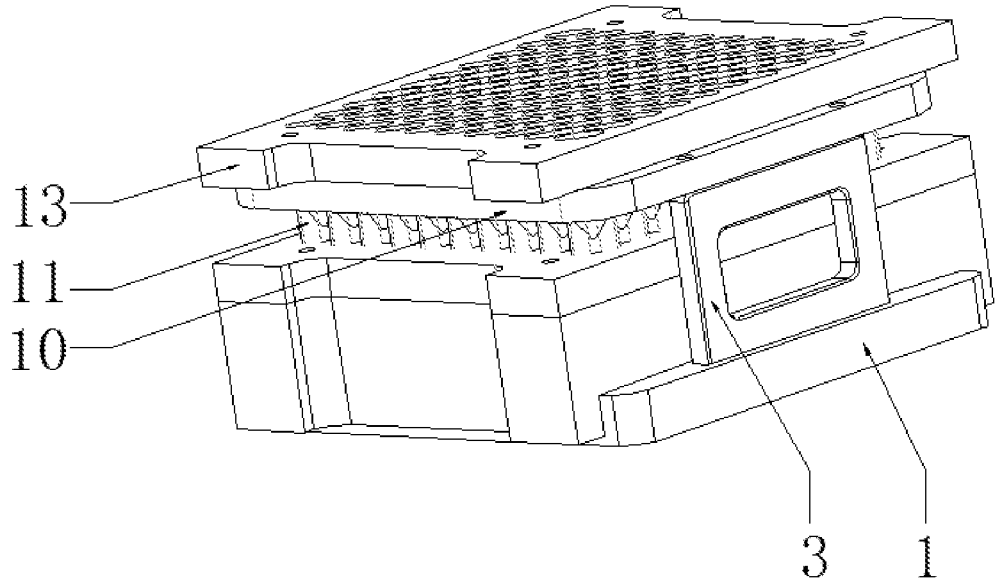
FIG. 4 is a schematic view showing an overall structure according to the embodiments of the disclosure.

As shown in FIG. 3 and FIG. 4, the upper side of the installation side frame 3 is connected with a mouthpiece correction jig 9) and an upper end of the mouthpiece correction jig 9 is connected with a cigarette rod tray 10. An inside of the cigarette rod tray 10 is connected with a cigarette rod body 11, and an outer end of an upper side of the cigarette rod tray 10 is fixedly connected with a convex buckle 12. The mouthpiece tray 13 is connected with an upper end surface of the cigarette rod tray 10, and the mouthpiece tray 13 is internally connected with a mouthpiece body 14. The mouthpiece tray 13 is buckled with the mouthpiece correction jig 9, and a structure of the mouthpiece tray 13 is matched with a structure of the mouthpiece correction jig 9. Two convex buckles 12 are respectively arranged at left and right ends of an upper side of the mouthpiece correction jig 9. When the mouthpiece tray 13 is attached to an upper surface of the mouthpiece correction jig 9, on one hand, the convex buckles 12 can limit the mouthpiece tray 13 and the mouthpiece correction jig 9 when attached. and on the other hand, the convex buckles 12 can be buckled in corresponding notches on the lower surface of the mouthpiece tray 13 to ensure the stable installation of the mouthpiece tray 13 and the mouthpiece correction jig 9. The mouthpiece body 14 is internally provided with a reinforcing assembly 15 for leakage prevention.

Figure 5:
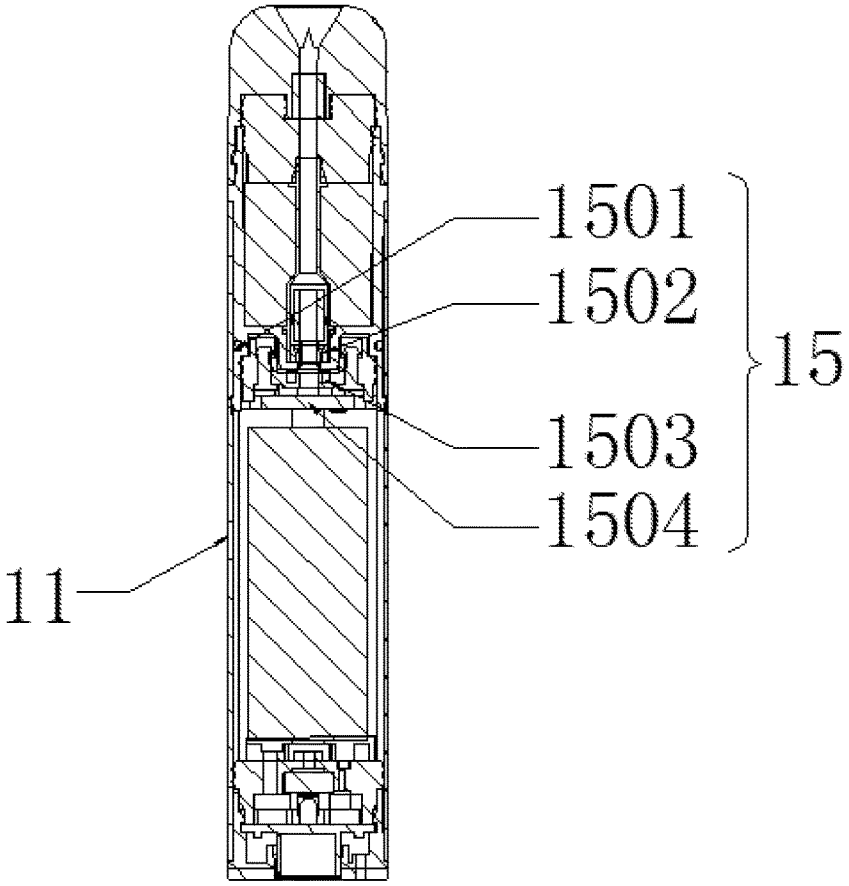
FIG. 5 is a schematic view showing a cigarette rod body and a cigarette rod body which are connected according to the embodiments of the disclosure.

As shown in FIG. 3 and FIG. 5. the reinforcing assembly 15 comprises a silica gel sealing ring 1501, a first leakage-proof groove 1502, a second leakage-proof groove 1503, a leakage-proof cotton 1504 and a leakage-proof protrusion 1505. A middle of an upper end of the silica gel sealing ring 1501 is provided with the first leakage-proof groove 1502, an inner side of the upper end of the silica gel sealing ring 1501 is provided with the second leakage-proof groove 1503, a lower end of an inner side of the silica gel sealing ring 1501 is connected with the leakage-proof cotton 1504, and an upper end of a lower side of the silica gel sealing ring 1501 is provided with the leakage-proof protrusion 1505. Two first leakage-proof grooves 1502 are symmetrically arranged about a vertical central axis of the silica gel sealing ring 1501, and an outer wall connecting surface of the silica gel sealing ring 1501 and an inner wall connecting surface of the mouthpiece body 14 are mutually attached to each other. Attaching one piece of silica gel sealing ring 1501 at a position where the cigarette rod body 11 and the mouthpiece body 14 are buckled can prevent the airflow from spreading and make the airflow of the product more concentrated. Accordingly, two first leakage-proof grooves 1502 are provided at the upper end of the silica gel sealing ring 1501, which can clamp a heating element lead and prevent the liquid from flowing down the lead, thus playing a certain leakage-proof effect. In addition, the second leakage-proof groove 1503 is also arranged in the middle of the inner side of the silica gel sealing ring 1501 to prevent part of the liquid from being left. The residual liquid is absorbed by the anti-leakage cotton 1504. Meanwhile, the bottom side of the silica gel sealing ring 1501 is provided with the anti-leakage protrusion 1505, so that even if liquid flows down, the liquid cannot flow to a control panel below through the anti-leakage protrusion 1505, thereby strictly protecting the control panel.

To sum up, when the auxiliary apparatus for E-liquid transportation and injection is used, firstly, the installation side frames 3 are clamped in the limiting notches 2 with the same structural size opened at the inner side of the upper end of the installation base 1 for installation, and the installation side frames 3 are easy to disassemble from and assemble with the installation base through a clamping connection with the limiting notches 2, which facilitates overall maintenance and replacement. Correspondingly, the whole installation side frame 3 is internally provide with a square through hole, which is convenient for users to grasp and use on one hand, and a material of the whole apparatus is saved and a whole weight of the apparatus is reduced on the other hand. Then, the lower swing disc jig 5 and the upper swing disc jig 7 are attached to the inner sides of the installation side frames 3 for installation, and the upper swing disc jig 7 and the lower swing disc jig 5 are parallel to each other. When the cigarette body penetrates through the upper swing disc jig 7 and the lower swing disc jig 5, the use of the whole material is reduced without affecting a normal clamping stability through the upper swing disc jig 7 and the lower swing disc jig 5 which are not contacted. Meanwhile, it is more convenient for the whole electronic cigarette to be placed and taken out. The lower end of the corresponding lower swing disc jig 5 is provided with an inwardly-concaved groove 6, which can effectively prevent a bottom plastic sleeve from falling off. Then, the top end of the installation side frame 3 is attached and installed with the mouthpiece correction jig 9, and the cigarette rod body 11 is positioned through the installation holes 8 of the mouthpiece correction jig 9. The whole installation holes 8 are distributed in a structure inclined to the upper swing disc jig 7, so that more installation holes 8 can be planned on the surface of the upper swing disc jig 7 with a square structure, thus improving the utilization rate of the internal space of the whole upper swing disc jig 7. Then, when the mouthpiece tray 13 is attached to the upper surface of the mouthpiece correction jig 9, the mouthpiece tray 13 and the mouthpiece correction jig 9 are limited by the convex buckles 12, and the convex buckles 12 can be buckled in the corresponding notches on the lower surface of the mouthpiece tray 13 to ensure the stable installation of the mouthpiece tray 13 and the mouthpiece correction jig 9. In this case, the cigarette rod body 11 and the mouthpiece body 14 are attached and buckled to facilitate E-liquid injection, and one piece of silica gel sealing ring 1501 is attached at the position where the cigarette rod body 11 and the mouthpiece body 14 are buckled to prevent the airflow from spreading and make the airflow of the product more concentrated. Correspondingly, two first leak-proof grooves 1502 are provided at the upper end of the silica gel sealing ring 1501, which can clamp the heating element lead and prevent the liquid from flowing down the lead, thus achieving a certain leak-proof effect. In addition, the middle of the inner side of the silica gel sealing ring 1501 is also provided with the second leakage-proof groove 1503 which can prevent some liquid from being left, and the residual liquid is absorbed by the leakage-proof cotton 1504. Meanwhile, the bottom side of the silica gel sealing ring 1501 is provided with the leakage-proof protrusion 1505, so that even if the liquid flows down, the liquid cannot flow to the control panel below through the leakage-proof protrusion 1505, thereby strictly protecting the control panel, and thus completing the use process of the whole auxiliary apparatus for E-liquid transportation and injection.

The invention claimed is:

1. An auxiliary apparatus for E-liquid transportation and injection, comprising an installation base, a lower swing disc jig and a mouthpiece tray, wherein limiting notches are provided respectively at inner sides of two ends of the installation base, and an upper end of each of the limiting notches is connected with an installation side frame, a bump is fixedly connected with front and rear ends of an upper side of the installation side frame, the lower swing disc jig is connected to a lower end of an inner side of the installation side frame and an inwardly-concaved groove is provided in a middle of a lower end of the lower swing disc jig, an upper end of the inner side of the installation side frame is connected with an upper swing disc jig and a middle of the upper swing disc jig is provided with an installation hole, the upper side of the installation side frame is connected with a mouthpiece correction jig and an upper end of the mouthpiece correction jig is connected with a cigarette rod tray, an inside of the cigarette rod tray is connected with a cigarette rod body, an outer end of an upper side of the cigarette rod tray is fixedly connected with a convex buckle, the mouthpiece tray is connected with an upper end surface of the cigarette rod tray, the mouthpiece tray is internally connected with a mouthpiece body, and the mouthpiece body is internally provided with a reinforcing assembly for leakage prevention.

2. The auxiliary apparatus for E-liquid transportation and injection according to claim 1, wherein the installation side frame is buckled with the installation base, two installation side frames are symmetrically arranged about a vertical central axis of the installation base, and the installation side frame is hollow.

3. The auxiliary apparatus for E-liquid transportation and injection according to claim 1, wherein the upper swing disc jig and the lower swing disc jig are distributed in parallel, and the lower swing disc jig is in a concave shape.

4. The auxiliary apparatus for E-liquid transportation and injection according to claim 1, wherein the installation holes are evenly distributed inside the upper swing disc jig and the installation holes are obliquely distributed.

5. The auxiliary apparatus for E-liquid transportation and injection according to claim 1, wherein the mouthpiece tray is buckled with the mouthpiece correction jig, and a structure of the mouthpiece tray is matched with a structure of the mouthpiece correction jig.

6. The auxiliary apparatus for E-liquid transportation and injection according to claim 1, wherein the reinforcing assembly comprises a silica gel sealing ring, a first leakage-proof groove, a second leakage-proof groove, a leakage-proof cotton and a leakage-proof protrusion, a middle of an upper end of the silica gel sealing ring is provided with the first leakage-proof groove, an inner side of the upper end of the silica gel sealing ring is provided with the second leakage-proof groove, a lower end of an inner side of the silica gel sealing ring is connected with the leakage-proof cotton, and an upper end of a lower side of the silica gel sealing ring is provided with the leakage-proof protrusion.

7. The auxiliary apparatus for E-liquid transportation and injection according to claim 6, wherein two first leakage-proof grooves are symmetrically arranged about a vertical central axis of the silica gel sealing ring, and an outer wall connecting surface of the silica gel sealing ring and an inner wall connecting surface of the mouthpiece body are mutually attached to each other.

* * * * *